US005509693A

United States Patent [19]

Kohls

[11] Patent Number: 5,509,693

[45] Date of Patent: Apr. 23, 1996

[54] PROTECTED PRINTED IDENTIFICATION CARDS WITH ACCOMPANYING LETTERS OR BUSINESS FORMS

[75] Inventor: Scott R. Kohls, Springboro, Ohio

[73] Assignee: NCR Corporation, Dayton, Ohio

[21] Appl. No.: 192,524

[22] Filed: Feb. 7, 1994

[51] Int. Cl.[6] ..... B42D 15/00

[52] U.S. Cl. ..... 283/75

[58] Field of Search ..... 462/6, 25, 26, 462/64, 65, 900; 283/67, 70, 74, 75, 107–109, 105

[56] References Cited

U.S. PATENT DOCUMENTS

| | | | |
|---|---|---|---|
| 4,982,894 | 1/1991 | Schmidt | 283/75 X |
| 5,172,938 | 12/1992 | Schmidt | 283/75 X |
| 5,312,136 | 5/1994 | Capozzola | 283/75 |
| 5,320,387 | 6/1994 | Carlson | 283/75 |

*Primary Examiner*—Willmon Fridie

*Attorney, Agent, or Firm*—Craig E. Miller

[57] ABSTRACT

Protected printed identification cards with accompanying letters or business forms preferably consisting of a printed bond sheet having a laminate liner adhered thereto. Portions of the printed bond sheet and the laminate liner have die cuts to permit removal of the protected printed identification card from the accompanying letter or business form. To form the final protected printed identification card, a portion of the printed bond sheet and a corresponding double-wide portion of the laminate liner are pulled from the back of the accompanying letter or business form. The extending portion of the laminate liner is then folded over the front surface of the printed bond sheet to form the final protected printed identification card. An exposed adhesive on the entire surface of the top and bottom laminate liner layers adheres to the front and back surfaces, respectively, of the printed bond sheet to form a durable, tamper-resistant protected printed identification card. The protected printed identification cards are capable of being printed as part of accompanying letters or other business forms and are compatible with non-impact printing equipment, including hot fusion laser printers.

25 Claims, 9 Drawing Sheets

PROTECTED PRINTED IDENTIFICATION CARDS WITH ACCOMPANYING LETTERS OR BUSINESS FORMS

CROSS REFERENCE

Cross reference is made to copending U.S. patent application Ser. No. 08/192,523, filed concurrently herewith and entitled "Printed Identification Cards with Accompanying Letters or Business Forms" which is assigned to the same assignee as the present invention.

BACKGROUND AND SUMMARY OF THE INVENTION

The present invention relates generally to new and novel improvements in protected printed identification cards with accompanying letters or business forms. More particularly, the present invention relates to protected printed identification cards with accompanying letters or business forms, preferably capable of having information printed thereon using non-impact printers, such as laser printers, which are laminated after printing to provide cost effective, durable identification cards suitable for carrying in, for example, wallets and purses.

Many government organizations and private businesses, both for-profit and non-profit, periodically issue identification cards to, for example, identify members, provide insurance terms or provide information about the issuing organization. Examples of such identification cards include driver's licenses, social security cards, employee identification cards, organization membership cards, insurance cards and many others. It is often desirable for the issuing organization to issue such identification cards with accompanying letters or business forms which, for example, include further information about the issuing organization or the use of the identification cards.

Many issuing organizations wish to provide identification cards which are sufficiently durable to both allow the end user to carry the identification cards on a regular basis and convey a positive image of the issuing organization to the end user. In general, the more often an end user views an identification card, the more often the end user has an opportunity to think of, and perhaps use, the goods and services of the issuing organization.

However, identification cards which are carried by end users on a regular basis can experience a hostile environment. For example, identification cards are often placed inside wallets, or in other confined spaces, which are carried and handled on a daily basis. Similarly, the contents of a purse are often handled on a daily basis. Furthermore, the ink from printed images on identification cards can interact with polymeric materials, such as picture holders or dividers, often present in wallets and purses. As a practical matter, once an identification card is damaged, or illegible, it is often removed from the wallet or purse, and is either discarded or placed in a more remote location. In any case, a damaged or illegible identification card is of limited use to the end user, and can convey a negative image of the issuing organization to the end user. On the other hand, since identification cards are often printed and issued in large numbers, the cost of printing and preparing conventional durable identification cards can be cost prohibitive.

Applicant is aware of several types of construction for identification cards which are is use today. A first known type of construction for printed identification cards involves printing images using conventional printing equipment on heavy weight paper tag stock and perforating a portion of the stock to form the printed identification card. Disadvantages of such an identification card include the fact that the printed information is unprotected and therefor subject to smearing and damage. Also, many conventional printers have difficulty handling heavy weight paper tag stock.

A second known type of construction for printed identification cards is similar the first type of construction described above, but after printing, the heavy weight paper tag stock is processed through a laminating machine to laminate the front and/or back of the entire sheet. The portion of the sheet to be used as an identification card is then perforated for removal. Typically, several printed identification cards are formed on a single sheet and individual printed identification cards are then manually matched up with the accompanying letters or business forms. This process is labor intensive and can create errors in matching up the printed identification cards with the correct accompanying letter or business form. Furthermore, while the printed information may be protected by the laminate, one disadvantage is that many conventional printers have difficulty handling heavy weight paper tag stock. One known supplier for equipment to produce these types of identification cards is Graphic Technology Systems, Inc. in Los Angeles, California.

A third known type of construction for printed identification cards uses a heavy weight paper tag stock for the entire form with a laminate spot coated on a portion of the front and/or back surface in the area of the identification card. Examples of this type of construction are show in U. S. Pat. Nos. 5,096,229 and 5,131,686. The portion of the sheet to be used as an identification card is then perforated for removal by the end user. One disadvantage of this type of construction is that since the printed images are printed on the laminate, the printed images are left unprotected, and thus subject to smearing or damage. Also, the same disadvantage that many conventional printers have difficulty handling heavy weight paper tag stock is still present. One known supplier for these types of printed identification cards is Innovative Printing Corporation in Minneapolis, Minnesota.

A fourth known type of construction for printed identification cards consists of applying a separate identification card, often fabricated from a plastic material, adhered to a separate letter or business form, typically fabricated from paper stock. Many variations of this type of construction as to the thickness, type and materials used to fabricate the identification cards, as well as the accompanying letters and business forms, can be found. Furthermore, portions of the plastic identification cards may be coated or have a rougher texture to assist in retaining printed information thereon. While such plastic identification cards do demonstrate good durability, they generally cannot be processed through non-impact printing equipment, such as laser printers. Furthermore, the printed information on the identification cards are left unprotected, which may create printed image adhesion difficulties, particularly since the printed identification cards are often fabricated from a plastic material. One known supplier of these types of identification cards with accompanying letters or business forms is FormStore Incorporated in Fenton, Missouri.

A fifth known type of construction for printed identification cards is similar to the fourth known type of construction described above, except the plastic identification cards are positioned in a debossed portion on the accompanying letters or business forms. This type of construction has many of the same disadvantages described above, including the fact that the identification cards cannot generally be processed through conventional nonimpact printers, such as laser printers. One known supplier of these types of identification cards is FormStore Incorporated in Fenton, Missouri.

A sixth known type of construction for printed identification cards utilizes a heavy weight paper tag stock or a plastic face stock for the identification cards which are joined by an adhesive to a release liner. The heavy weight paper tag stock or plastic face stock is die cut to form the identification card. An adhesive is selected which releases cleanly so the identification cards are not tacky on their back surface. Typically, an entire sheet of heavy weight paper tag stock or plastic face stock can be fabricated in this manner to form multiple identification cards. Individual printed identification cards are then manually matched up with the accompanying letters or business forms. This process is both labor intensive and subject to matching errors. Furthermore, the cost of the plastic face stock and release liner for this type of construction can be cost prohibitive in many applications.

A seventh known type of construction for printed identification cards is also a pressure sensitive type construction. A second adjoining panel is used to laminate over the front of the identification card. This type of construction generally utilizes a heavy weight tag stock with a laminate release liner. After the appropriate information is printed on the identification card, the identification card is punched out, the laminate panel peeled off, and the laminate is folded and sealed over the printed information on the front of the printed identification card. In the known construction of this type being marketed, the entire sheet is made from the heavy stock and is laminated completely. Thus, as in the sixth known type of prior art construction described above, this type of construction does not provide a combination of a printed identification card and accompanying letter or business form, per se. One known supplier of printed identification cards having this type of construction is Avery Dennison of Pasadena, California.

An eighth known type of construction for printed identification cards is also a full sheet pressure sensitive label construction. After the face stock is printed, a duel panel card is removed, flipped over, and placed back into a laminate window. The dual panel card is then pushed out through the window with the laminate attached and is then folded over to form the final printed identification card. One disadvantage of this type of construction is that only the outer edge of the laminate forms the bond between the two panels. Furthermore, as in the sixth known prior art type of construction discussed above, this type of construction is not a combination of an identification card and accompanying letter or business form, per se. One known supplier of printed identification cards having this type of construction is being marketed as the "Self Laminating I.D. Card" by The Standard Register Company in Dayton, Ohio.

A ninth known type of construction for printed identification cards is an integrated construction which uses the form stock as the basis for the printed identification card. In this type of construction, a liner is placed on one side of the printed identification card and information is often printed on the top surface of the liner. One disadvantage of this type of construction is that since the printed information is printed on the smooth liner surface and is not protected, the printed information is subject to smearing and damage. Furthermore, since the identification card thickness is relatively thin to facilitate feeding through a conventional non-impact printer, the final printed identification card is also relatively thin and does not have the desired rigidity and durability. One known supplier of printed identification cards having this type of construction is marketed as the "Docu-Label" by The Standard Register Company in Dayton, Ohio.

A final known type of construction for printed identification cards is shown in U.S. Pat. No. 4,986,868. This type of construction uses a lap joined form/label which incorporates a self-adhesive laminate applied to the back of a continuous form. The laminate is twice as wide as the form which allows the laminate to fold over the front surface of the form. The laminate area that extends out from behind the forms portion is initially covered by a silicone coated liner. This silicone coated liner is peeled off exposing the self-adhesive laminate. The laminate is then folded over to cover the front of the printed identification card. In this type of construction, the entire back surface of the continuous paper sheet is laminated. Also, as in several of the other prior art designs, this type of construction is not a combination identification card and accompanying letter or business form, per se. One known supplier of printed identification cards having this type of construction is marketed as the "Wal-Card" by Wallace Business Forms, Inc. in Hillside, Illinois.

As described above, all of the above known prior art types of construction for printed identification cards have disadvantages which limit their acceptance by the issuing organizations, or the end user, or both.

Accordingly, an object of the present invention is the provision of protected printed identification cards with accompanying letters or business forms which are capable of having information printed thereon by conventional high speed non-impact printers resulting in strong, long-lasting identification cards which can be retained and carried by end users.

Another object of the present invention is to provide protected printed identification cards which can be printed as part of an outgoing letter or business form.

Yet another object of the present invention is to provide protected printed identification cards with accompanying letters or business forms having a durable protective layer overlying the printed information to prevent smearing and damage to the printed information and interaction between the printed information and other materials which commonly come into contact with the printed identification cards in their operating environments.

Still another object of the present invention is to provide protected printed identification cards with accompanying letters or business forms which are compatible with conventional non-impact printing equipment, such as laser printers.

A further object of the present invention is to provide protected printed identification cards with accompanying letters or business forms which are transported through the printing equipment and printed as a single layer thickness, but which are then folded over to provide a greater thickness in the resulting protected printed identification cards.

A still further object of the present invention is to provide protected printed identification cards with accompanying letters or business forms which resist separation of the protected printed identification cards and tampering of information printed thereon.

Yet a further object of the present invention is to provide protected printed identification cards with accompanying letters or business forms which provide security and protection for information printed thereon, including machine readable and hand written information, and deter tampering of information printed thereon.

These and other objects of the present invention are attained by the provision of protected printed identification cards preferably consisting of a printed bond sheet having a laminate liner adhered thereto. Portions of the printed bond sheet and the laminate liner have die cuts to permit removal of the protected printed identification card from the accompanying letter or business form. To form the final protected printed identification card, a portion of the printed bond sheet and a corresponding double-wide portion of the laminate liner are pulled from the back of the accompanying letter or business form. The extending portion of the laminate liner is then folded over the front surface of the printed bond sheet to form the final protected printed identification card. An exposed pressure sensitive adhesive on the entire surface of the top and bottom laminate liner layers adheres to the front and back surfaces, respectively, of the printed bond sheet to form a durable, tamper-resistant protected printed identification card. The protected printed identification cards are capable of being printed as part of accompanying letters or other business forms and are compatible with non-impact printing equipment, such as laser printers.

Other objects, advantages and novel features of the present invention will become apparent in the following detailed description of the invention when considered in conjunction with the accompanying drawings.

DETAILED DESCRIPTION OF THE DRAWINGS

Figure 1:
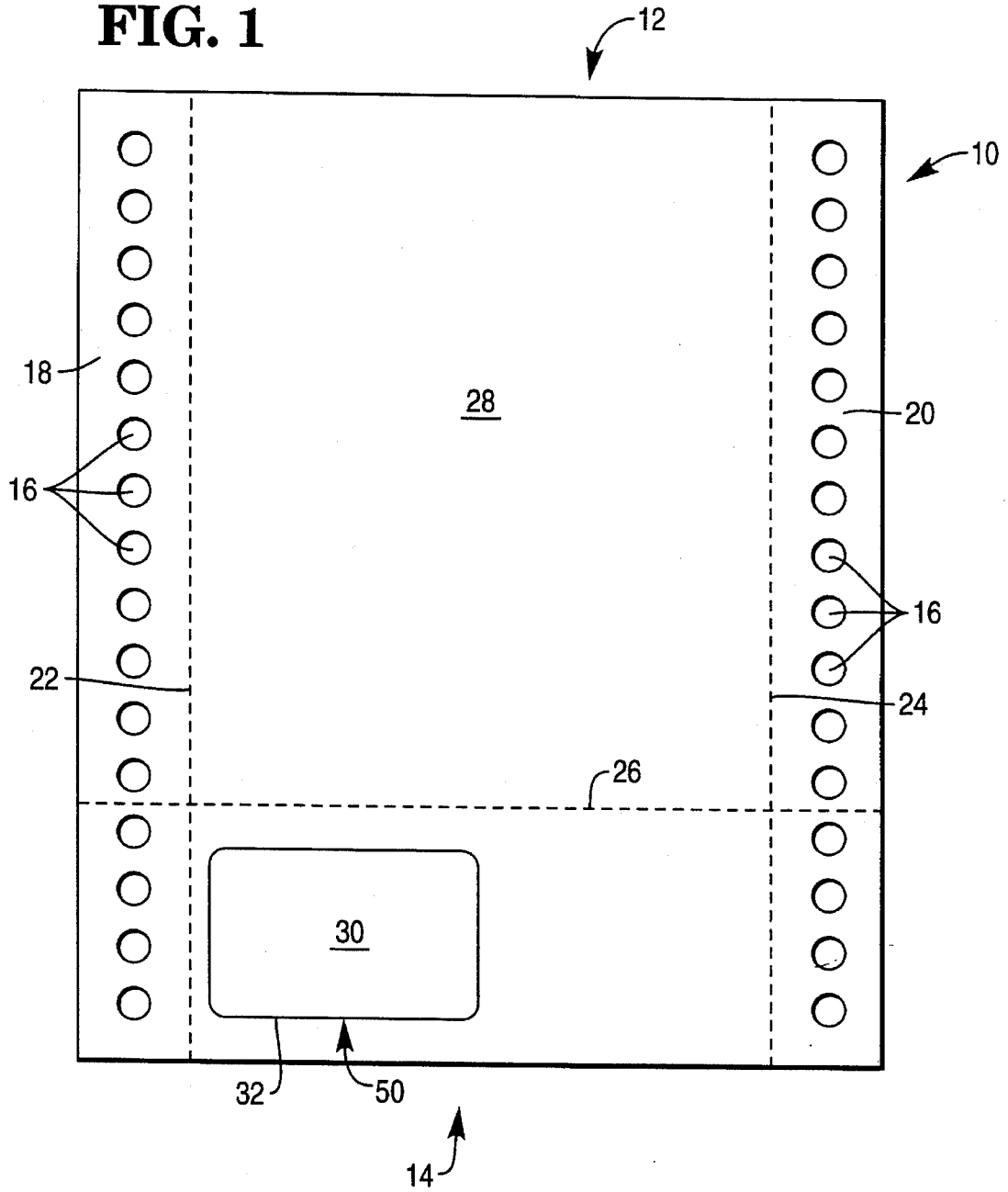
FIG. 1 illustrates a plan view of a preferred embodiment of a protected printed identification card with accompanying letter or business form in accordance with the present invention.
Figure 2:
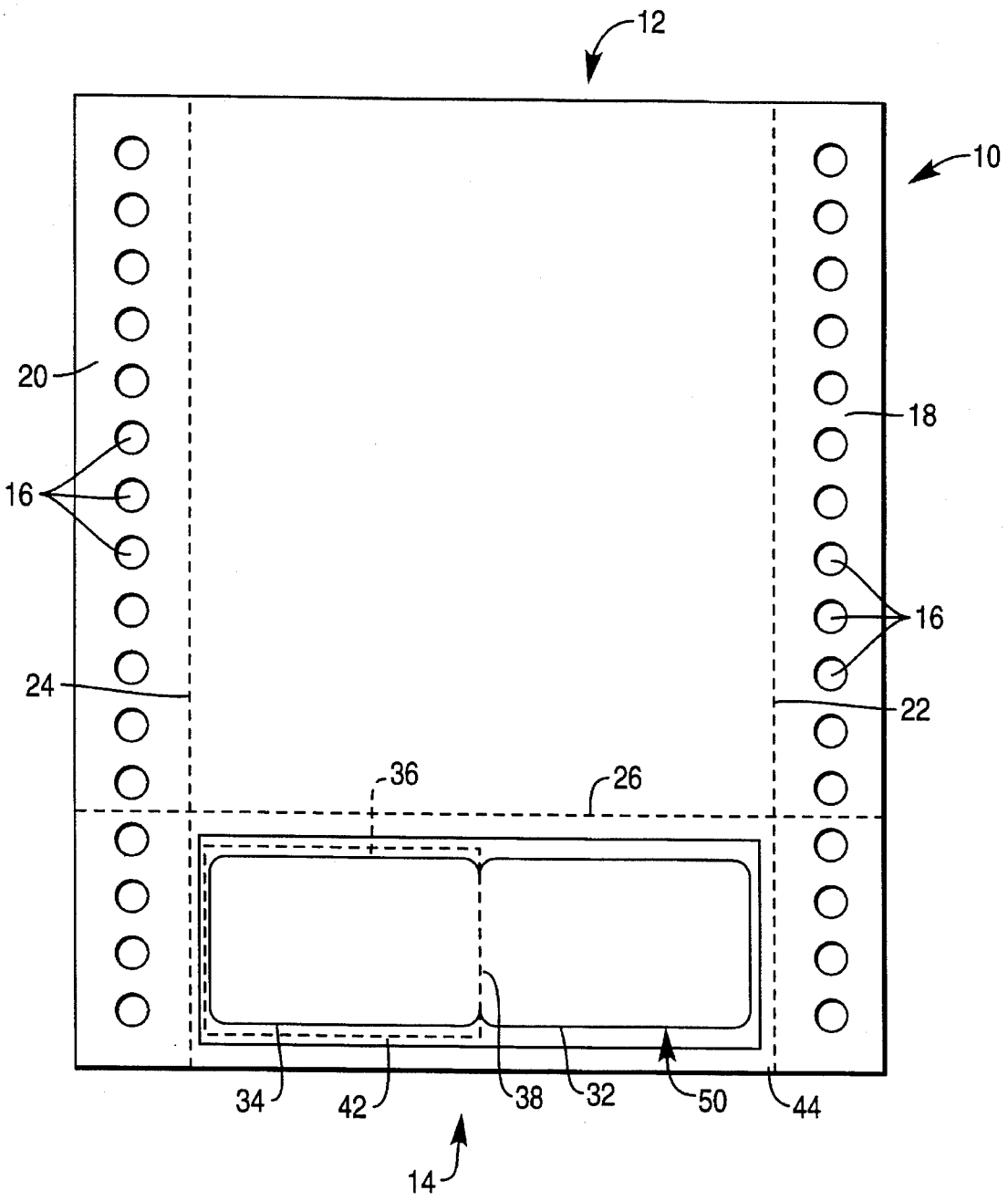
FIG. 2 is a back view of the preferred embodiment of the protected printed identification card with accompanying letter or business form shown in FIG. 1.

Referring now to the drawings, in which like-referenced characters indicate corresponding elements throughout the several views, attention is first drawn to FIGS. 1 and 2 which illustrate a preferred embodiment of protected printed identification card with accompanying letter or business form, generally identified by reference numeral 10. Protected printed identification card with accompanying letter or business form 10 generally includes letter or business form portion 12 and protected printed identification card portion 14. In the preferred embodiment of protected printed identification card with accompanying letter or business form 10 shown in FIGS. 1 and 2, letter or business form portion 12 and protected printed identification card portion 14 form a continuously fed letter or business form having printer feed holes 16, which are aligned with the feed pins in conventional continuous feed printing equipment. If desired, printer feed holes 16 are positioned in removable portions 18 and 20 having perforated lines 22 and 24, which allow removable portions 18 and 20 to be removed along perforated lines 22 and 24, and discarded after printing. Also, if desired, letter or business form portion 12 and protected printed identification card portion 14 can be joined by perforated line 26 to permit separation of letter or business form portion 12 and protected printed identification card portion 14.

Referring to FIG. 1, which shows a front view of printed identification card with accompanying letter or business form 10, letter or business form portion 12 and protected printed identification card portion 14 are preferably fabricated from a continuous sheet of bond stock. Information for the end user can be printed on front surface 28 of letter or business form portion 12. At the same time, information can be printed on front face 30 of protected printed identification card portion 14. Also, silicon spot coat 36 is applied to back surface 44 of the continuous sheet of bond stock at least over the area inside the perimeter of partial die cut 34 to permit release of laminate liner 42 from the continuous sheet of bond stock. Die cut 32 defines the perimeter of front face 30 of protected printed identification card 50. Die cut 32 preferably extends through the continuous sheet of bond stock along all four sides, as well as through laminate liner 42 on the top, left and bottom sides as viewed in FIG. 1, as will be discussed in further detail in conjunction with FIGS. 2 and 4.

Figure 4:
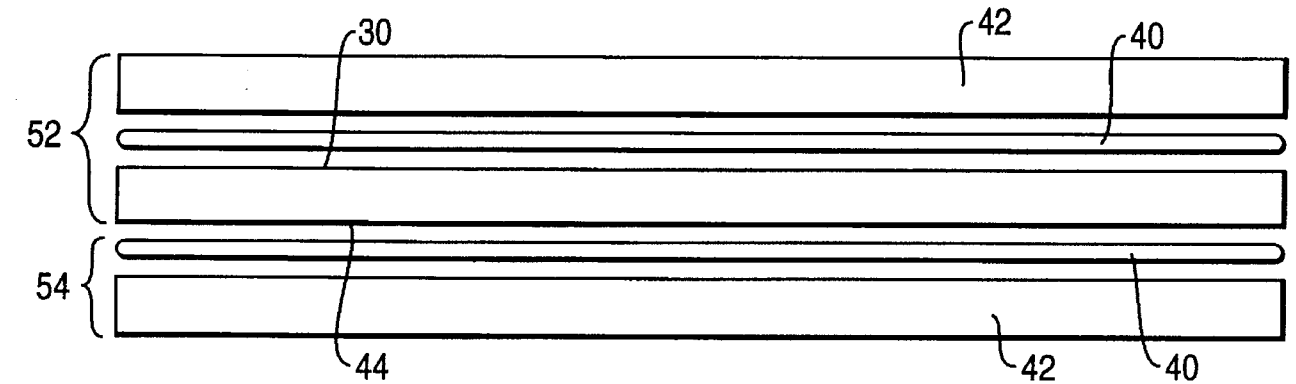
FIG. 4 is a side view of the protected printed identification card shown in FIG. 1 as removed from the accompanying letter or business form and folded to form final protected printed identification card.

Referring now to FIGS. 2 and 4, pressure sensitive adhesive 40 and laminate liner 42 are applied to back surface 44 of protected printed identification card portion 14. Die cut 32 extends through laminate liner 42 along the top, right and bottom sides as viewed in FIG. 2, as well as through the continuous sheet of bond stock along all four sides as discussed above in conjunction with FIG. 1. Partial perforated line 38 preferably extends through laminate liner 42 only and is aligned with the right side of die cut 32 as viewed in FIG. 1. In addition, partial die cut 34 defines the perimeter of laminate liner 42 which will fold over and protect front face 30 of protected printed identification card 50. Partial die cut 34 preferably extends through laminate liner 42 only, and does not extend into the continuous sheet of bond stock.

Once protected printed identification card with accompanying letter or business form 10 is completed as described above, variable information can be printed on front surface 28 of letter or business form portion 12 and/or on front face 30 of protected printed identification card portion 14, as desired. This printing operation can be carried out using conventional printing equipment, including non-impact printing equipment, such as hot fusion laser printing equipment.

Figure 3:
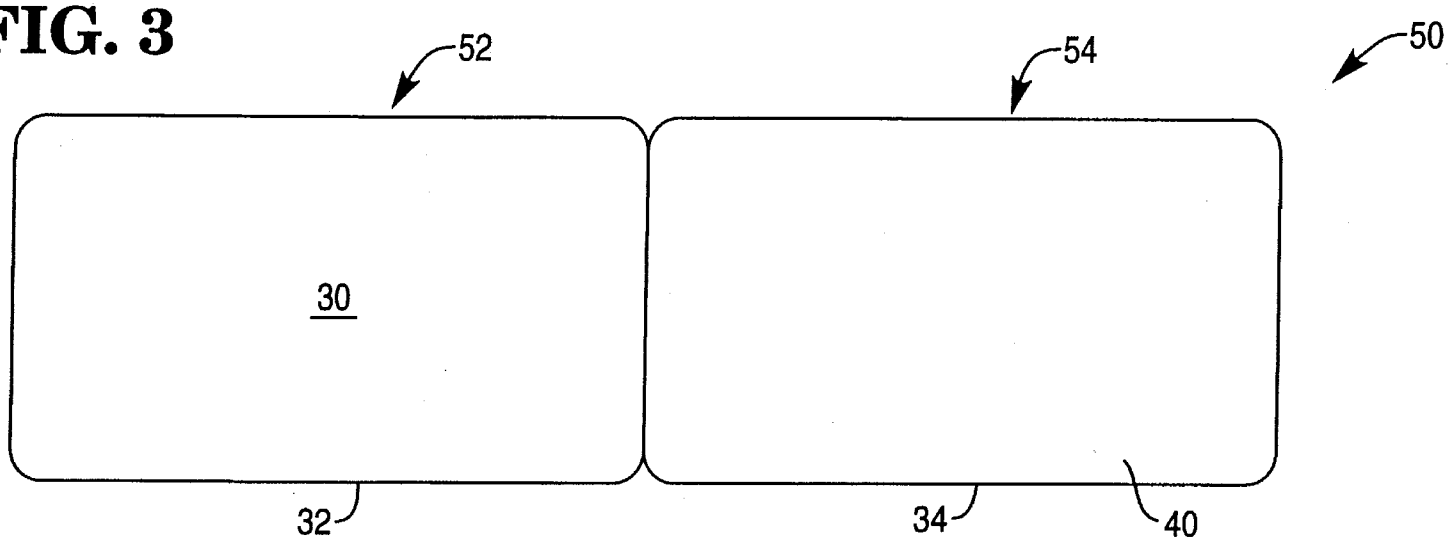
FIG. 3 is a back view of the preferred embodiment of protected printed identification card shown in FIG. 1 as removed from the accompanying letter or business form and prior to being folded over into a final protected printed identification card.

Referring now to FIG. 3, protected printed identification card 50 is shown removed from printed identification card portion 14 by pushing front face 30 of protected printed identification card 50 rearwardly to form right-hand portion 52 and peeling laminate liner 42 away from the continuous sheet of bond stock along partial die cut 34 to form left-hand portion 54. As seen in FIG. 4, left-hand portion 54 is then folded over right-hand portion 52 along partial perforated line 38 to form finished protected printed identification card 50.

In the preferred embodiment of protected printed identification card with accompanying letter or business form 10 described above, the paper stock used is preferably 20 to 24 pound bond stock, the laminate liner used is preferably a 2 mil laser approved polyester film and a pressure sensitive adhesive is used to adhere the laminate liner to the paper stock.

Figure 5:
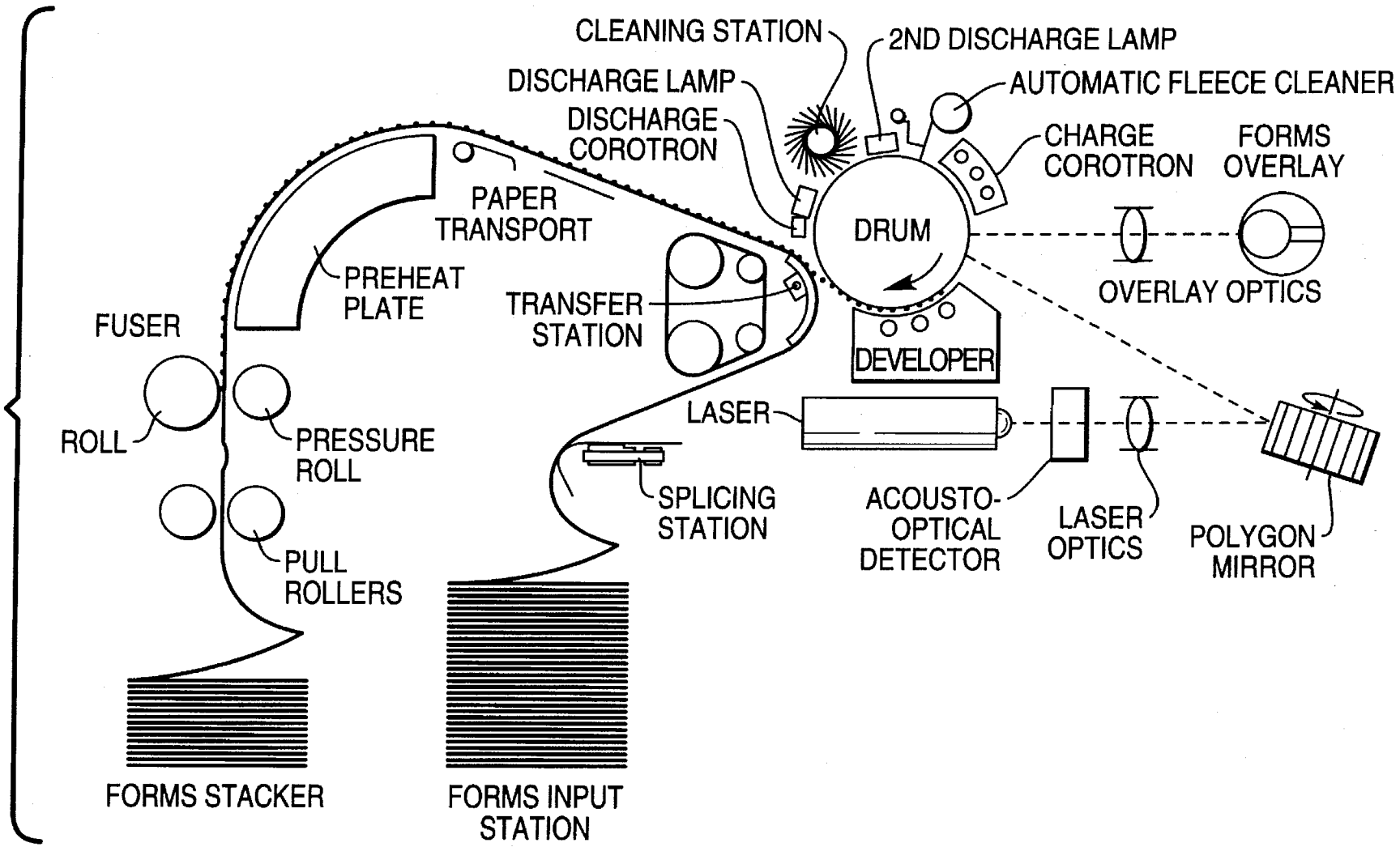
FIG. 5 a side view of the transport path of a representative non-impact printer capable of being used to print information on the preferred embodiment of protected printed identification card with accompanying letter or business form shown in FIG. 1, with portions of the transport path being shown with schematic representations.
Figure 6:
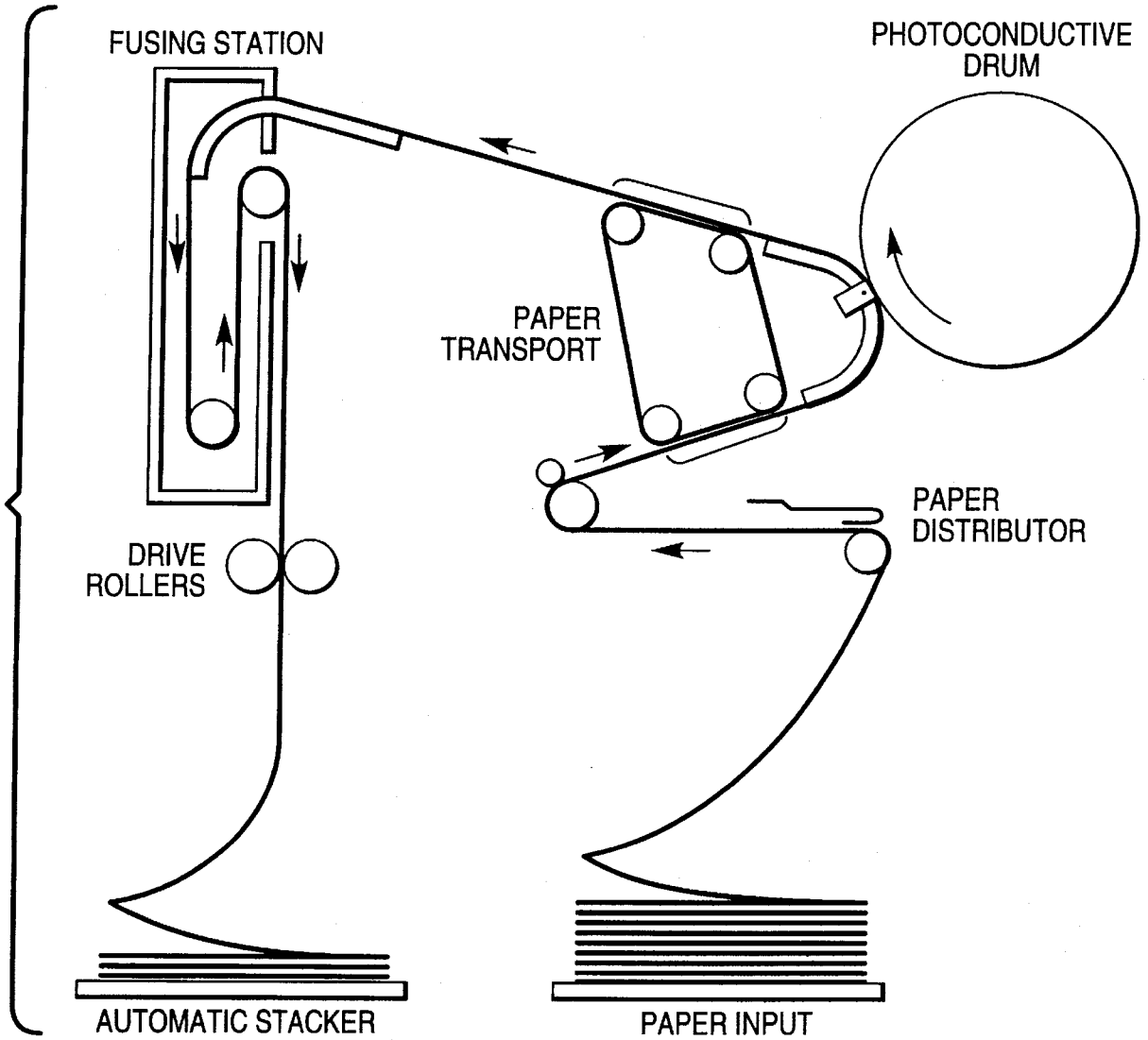
FIG. 6 is a side view of the transport path of an alternative non-impact printer capable of being used to print information on the preferred embodiment of protected printed identification card shown in FIG. 1, with portions of the transport path being shown with schematic representations.

Referring now to FIG. 5, a schematic representative of a non-impact printer using a dry toner which is fused to the paper with heat, pressure and/or a chemical process is shown. While the configuration and arrangement of this representative printer does not form a part of the invention described herein, it will be appreciated that the continuous paper web being fed must be sufficiently flexible to permit transfer through the printer. Furthermore, significant variations in the thickness of documents to be printed, such as those variations commonly present in documents having attached identification cards, can interfere with the limited printer clearance present between the transfer station and the photoconductive drum thus potentially causing damage to the photoconductive drum and printer downtime. Similarly, FIG. 6 shows a schematic representation of a "Siemens 2200 Laser Printer", manufactured by Siemens Nixdorf Printing Systems, L. P. of Boca Raton, Florida. While this "Siemens 2200 Laser Printer" has a tighter paper path than some laser printers, it is representative of many. When such a tight paper path is combined with the printer's high speed, high temperatures and high pressures, it will again be appreciated that the continuous paper web being fed through such printers experience a great deal of stress.

In general, thicker paper stock is more rigid and presents a greater likelihood that identification cards attached to paper stock will become detached as they are transported through a printer. Applied identification cards of 8 mils or more, particularly plastic cards, have been found to be problematic. Applied identification cards coming detached from the paper stock can result in severe printer damage. Resulting printer downtime and repair cost is both expensive, and causes loss of productivity. While the use of strong adhesives to hold the applied cards to the forms can alleviate the separation problem to some degree, such adhesives also make it difficult for the recipient to remove the applied identification card from the form. In addition, the use of identification cards fabricated from thinner materials are generally more subject to creases, folds, tears and a worn out appearance, and may experience a reduced life span.

Printed identification card 50 in accordance with a preferred embodiment of the present invention is constructed so it is relatively thin, approximately 6 mils, when it is printed, but is over 10 mils thick after it is folded by the recipient. Such a printed identification card is sufficiently thin and flexible to run through conventional non-impact printers, while providing a final protected printed identification card which is strong, sturdy, durable and has an improved life span.

Figure 7:
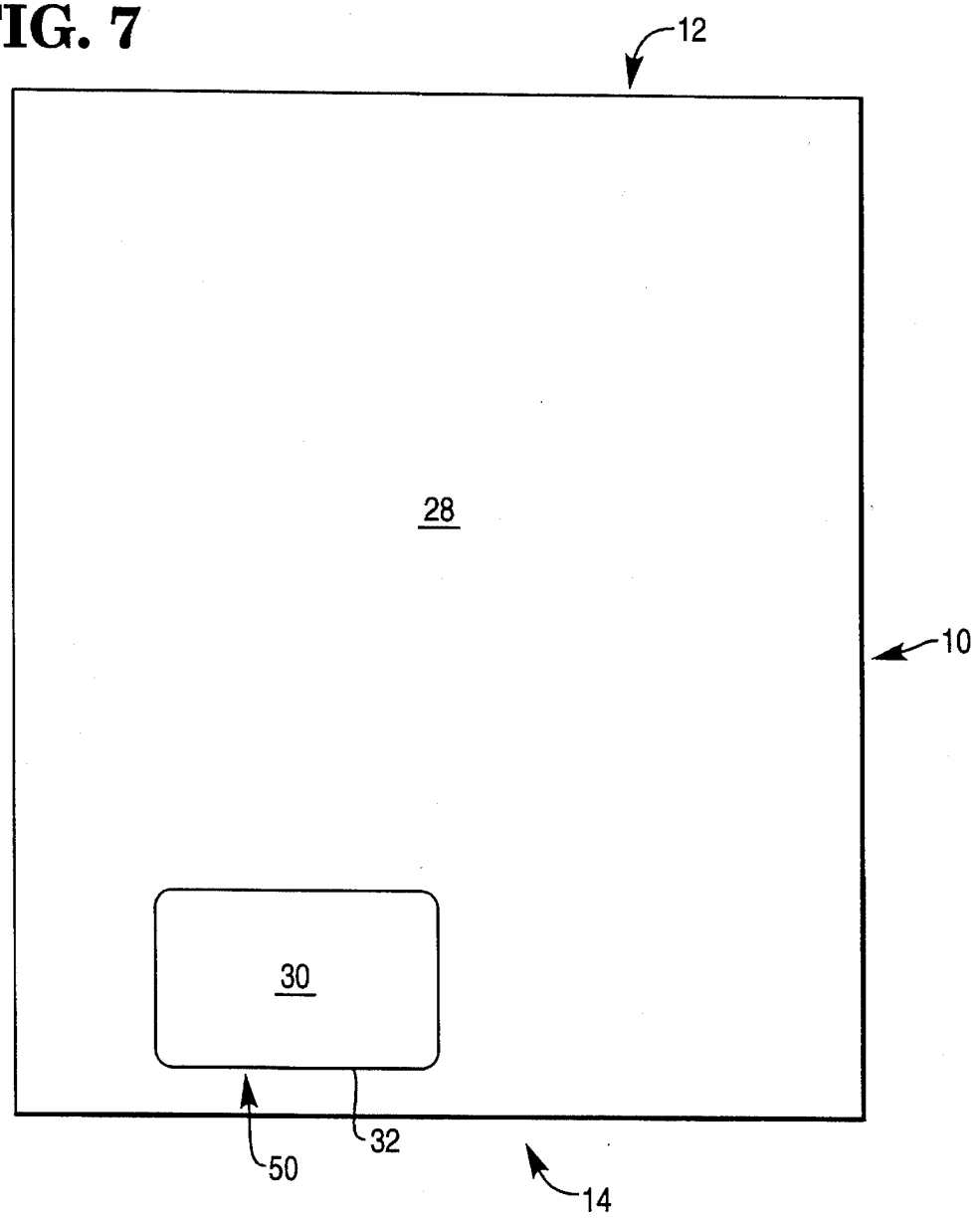
FIG. 7 is a plan view of the protected printed identification card shown in FIG. 1 in conjunction with a cut sheet format letter or business form.
Figure 8:
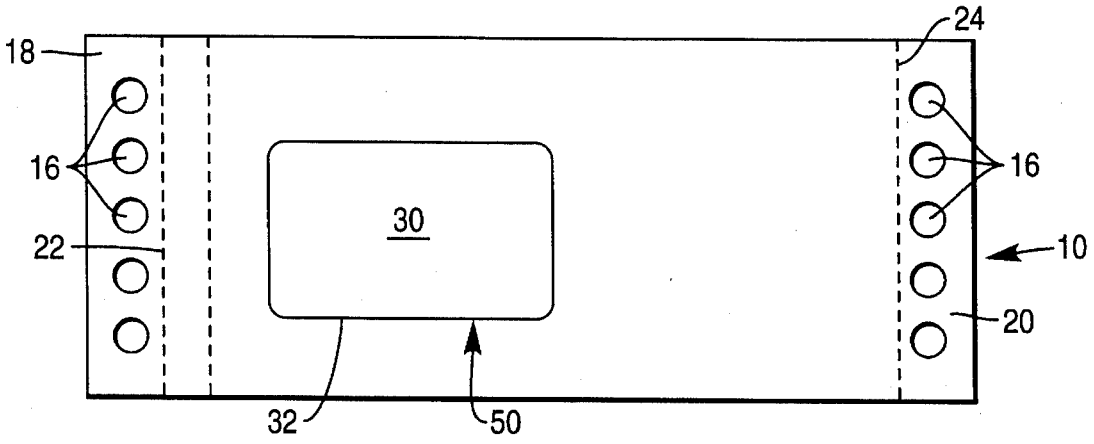
FIG. 8 is a plan view of the protected printed identification card shown in FIG. 1 in conjunction with a continuous mailer format letter or business form.
Figure 9:
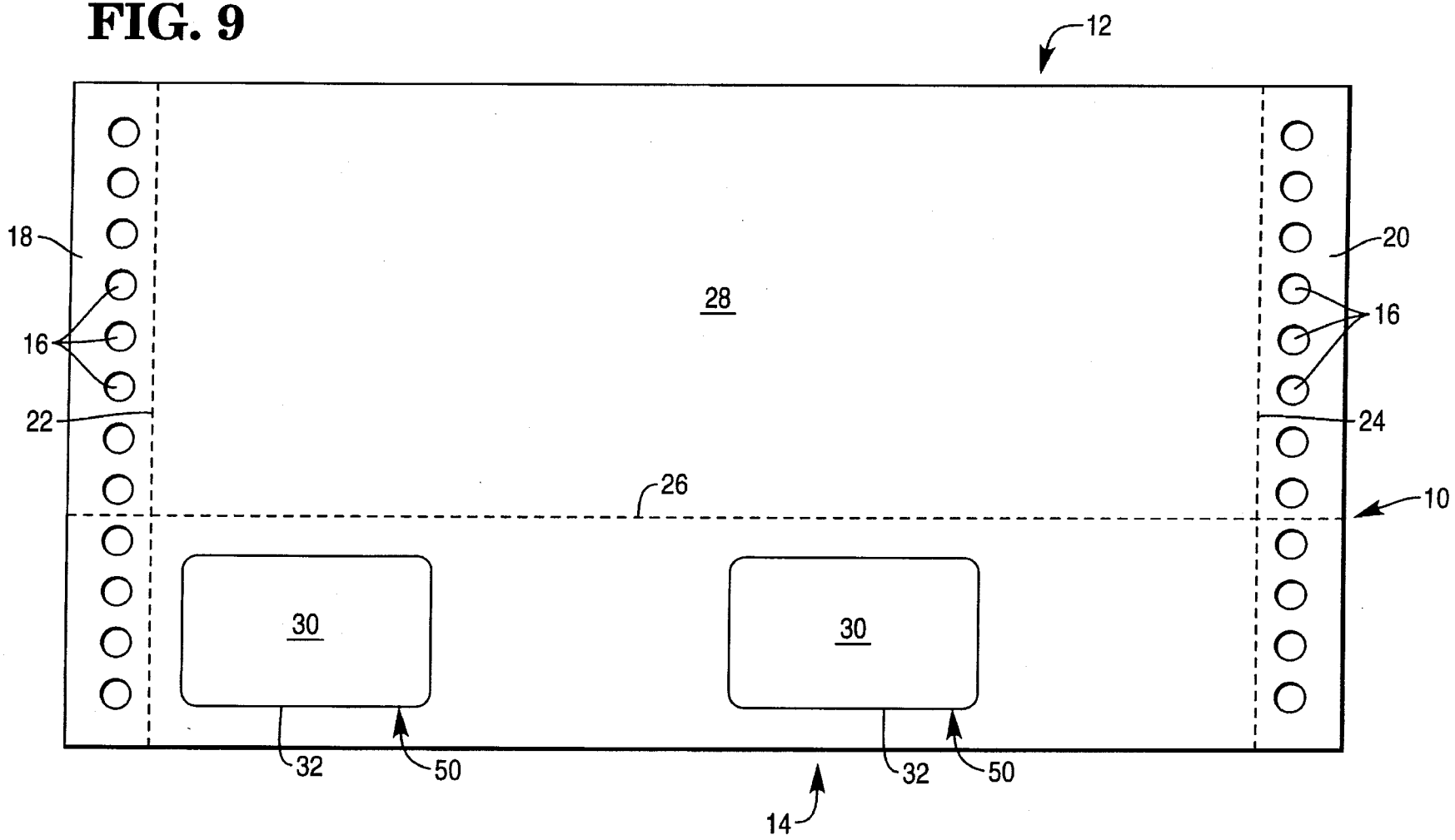
FIG. 9 is a plan view of the protected printed identification card shown in FIG. 1 in conjunction with a double wide continuous format letter or business form.
Figure 10:
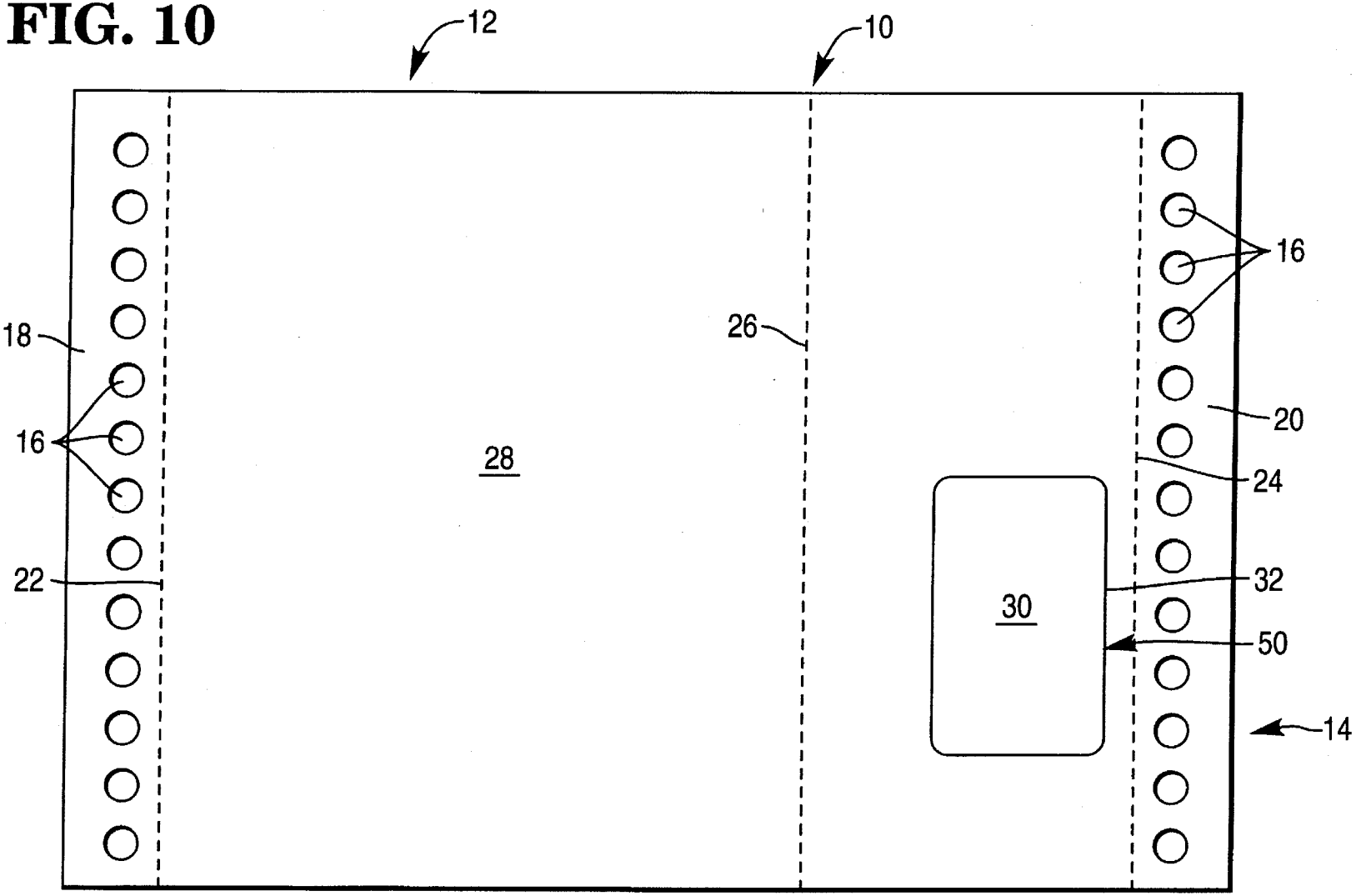
FIG. 10 is a plan view of the protected printed identification card shown in FIG. 1 in conjunction with a continuous format letter or business form showing the longitudinal axis of the protected printed identification card being aligned parallel to the feeding axis of the continuous format letter or business form.
Figure 11:
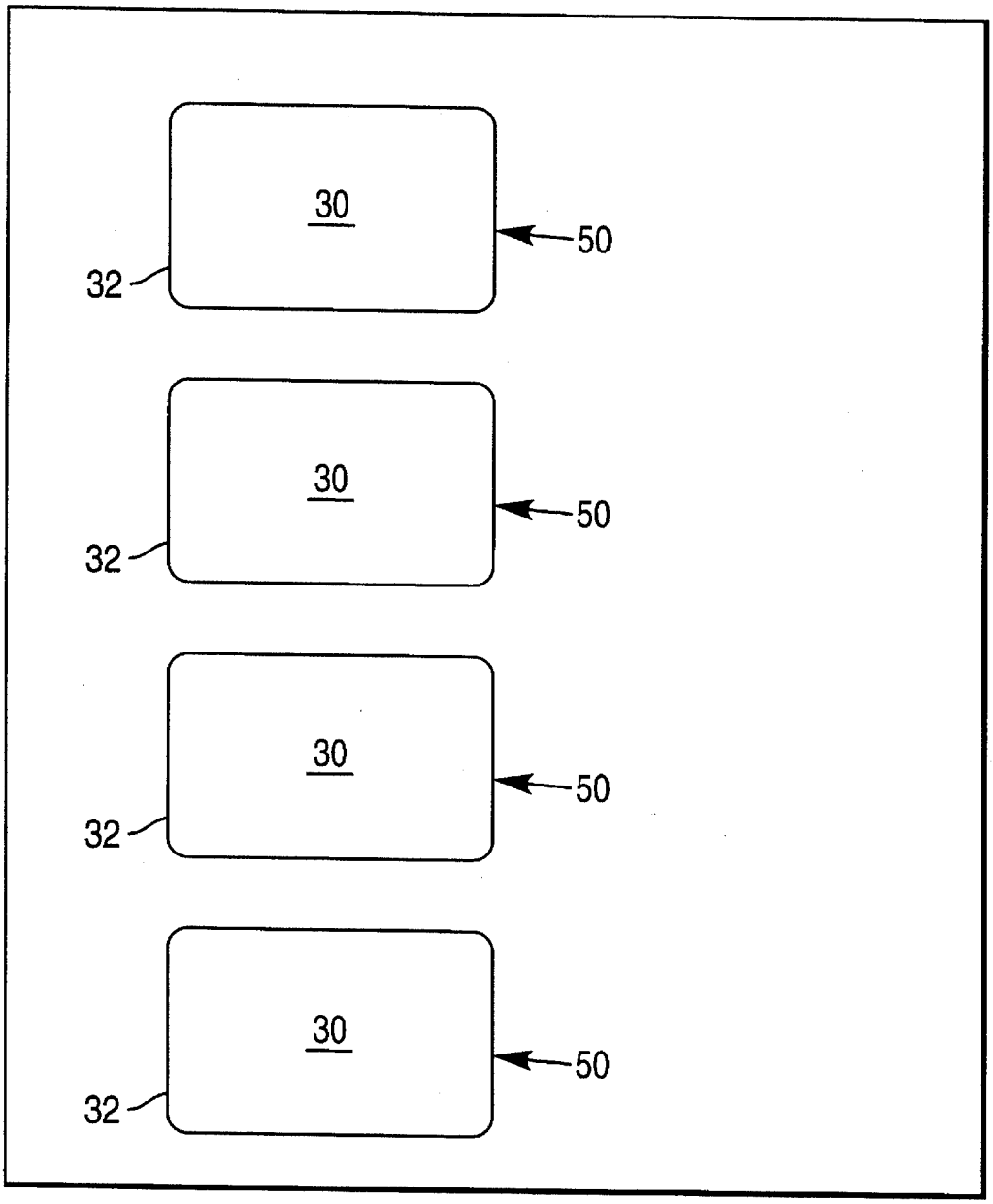
FIG. 11 is a plan view of the protected printed identification card shown in FIG. 1 showing multiple protected printed identification cards on a single sheet.

As will readily be seen by one having ordinary skill in the relevant art, several alternate configurations of protected printed identification card with associated letter or business form 10 are possible, some of which are shown in FIGS. 7 through 11, in which like-referenced characters indicate corresponding elements. FIG. 7 illustrates protected printed identification card 50 in conjunction with a letter or business form of a cut sheet configuration for feeding into a conventional non-impact printer capable of printing paper stock having cut sheet configuration. Figure 8 illustrates protected printed identification card 50 incorporated into a continuously fed printed self mailer business form where protected printed identification card 50 is included in the construction of the interior or final ply of the self mailer business form. FIG. 9 illustrates a double-wide protected printed identification card configuration which incorporates two independent protected printed identification cards 50 into a protected printed identification card with associated letter or business form 10. It will be appreciated that, if desired, more than two protected printed identification cards 50 could be incorporated into a single form, and this double-wide or multiple protected printed identification card configuration could be incorporated in continuous, cut sheet, roll in-feed or self mailer form construction. FIG. 10 illustrates that, if desired, the longitudinal axis of protected printed identification card 50 can be positioned along the longitudinal feed axis of the printed form. FIG. 11 illustrates that multiple protected printed identification cards 50 can be positioned on a single sheet. It will be appreciated that other variations and configurations will become readily apparent to one having ordinary skill in the relevant art by following the teachings of the present invention.

Although the present invention has been described above in detail, the same is by way of illustration and example only and is not to be taken as a limitation on the present invention. For example, the teachings of the present invention could be applied to other types of business forms. Accordingly, the scope and content of the present invention are to be defined only by the terms of the appended claims.

What is claimed is:

1. A protected printed identification card with associated letter or business form, comprising:

a paper stock sheet having a front surface and a back surface, said paper stock sheet having a silicon coat over a portion of said back surface of said paper stock sheet;

a laminate liner adhered by an adhesive to at least a part of said back surface of said paper stock sheet;

a die cut through said paper stock sheet and said laminate liner to form a rear portion of said protected printed identification card; and a partial die cut through said laminate liner corresponding with said die cut through said paper stock sheet and said laminate liner to form a front portion of said protected printed identification card, said front portion of said protected printed identification card is positioned over said portion of said paper stock coated with said silicon coat.

2. The protected printed identification card with accompanying letter or business form in accordance with claim 1, wherein said laminate liner is a polyester film and said adhesive is pressure sensitive adhesive.

3. The protected printed identification card with accompanying letter or business form in accordance with claim 1, wherein said rear portion of said protected printed identification card and said front portion of said protected printed identification card are joined by a partial perforated line to facilitate folding of said front portion over said rear portion.

4. The protected printed identification card with accompanying letter or business form in accordance with claim 1, wherein said protected printed identification card with accompanying letter or business form is of a continuous feed configuration for printing on said front surface of said paper stock sheet by non-impact printing equipment.

5. The protected printed identification card with accompanying letter or business form in accordance with claim 1, wherein said protected printed identification card with accompanying letter or business form is of a cut sheet configuration for printing on said front surface of said paper stock by non-impact printing equipment.

6. The protected printed identification card with accompanying letter or business form in accordance with claim 1, wherein said protected printed identification card with accompanying letter or business form is of a continuous feed self mailer configuration and said protected printed identification card is incorporated into a ply of said continuous feed self mailer.

7. The protected printed identification card with accompanying letter or business form in accordance with claim 6, wherein said ply of said continuous feed self mailer is an interior ply of said continuous feed self mailer.

8. The protected printed identification card with accompanying letter or business form in accordance with claim 6, wherein said ply of said continuous feed self mailer is a final ply of said continuous feed self mailer.

9. The protected printed identification card with accompanying letter or business form in accordance with claim 1, wherein two independent protected printed identification cards are incorporated in a double-wide configuration.

10. A method of forming a protected printed identification card with accompanying letter or business form, comprising the steps of:

providing a sheet of paper stock having a front surface and a rear surface;

coating a portion of said rear surface of said sheet of paper stock with a silicon coating;

adhering a laminate liner over at least a part of said rear surface of said sheet of paper stock;

making a die cut through said sheet of paper stock and through said laminate liner to form a rear portion of said protected printed identification card; and making a corresponding partial die cut through said laminate liner to form a front portion of said protected printed identification card.

11. The method of forming the protected printed identification card with accompanying letter or business form in accordance with claim 10, further including a step of lithographic printing information on said sheet of paper stock following the step of providing a sheet of paper stock having a front surface and a back surface.

12. The method of forming the protected printed identification card with accompanying letter or business form in accordance with claim 11, further including the step of printing information on said front surface of said sheet of said paper stock following the step of making a corresponding partial die cut through said laminate liner to form a front portion of said protected printed identification card.

13. The method of forming the protected printed identification card with accompanying letter or business form in accordance with claim 12, wherein said step of printing information on said front surface of said sheet of paper stock is performed by non-impact printing equipment.

14. The method of forming the protected printed identification card with accompanying letter or business form in accordance with claim 12, wherein said step of printing information on said front surface of said sheet of paper stock is performed by hot fusion laser printing equipment.

15. The method of forming the printed identification card with accompanying letter or business form in accordance with claim 10, further including the step of printing information on said front surface of said sheet of paper stock following the step of making a corresponding partial die cut through said laminate liner to form a front portion of said protected printed identification card.

16. The method of forming the protected printed identification card with accompanying letter or business form in accordance with claim 15, wherein said step of printing information on said front surface of said sheet of paper stock is performed by non-impact printing equipment.

17. The method of forming the protected printed identification card with accompanying letter or business form in accordance with claim 15, wherein said step of printing information on said front surface of said sheet of paper stock is performed by hot fusion laser printing equipment.

18. The method of forming the protected printed identification card with accompanying letter or business form in accordance claim 10, wherein said step of making a corresponding partial die cut through said laminate liner to form a front portion of said protected printed identification card also includes making a partial perforated line through said laminate liner between said front portion and said rear portion of said protected printed identification card.

19. The method of forming the protected printed identification card with accompanying letter or business form in accordance with claim 18, further including the steps of:

pushing said front face of said sheet of paper stock and adhered laminated liner rearwardly from said sheet of paper stock to form said rear portion of said protected printed identification card;

peeling said laminated liner rearwardly along said partial die cut away from said sheet of paper stock to form said front portion of said protected printed identification card;

folding said front portion of said protected printed identification card over said rear portion of said protected printed identification card along said partial perforated line; and adhering said adhesive exposed on said laminated liner with said front surface of said sheet of paper stock in said rear portion of said protected printed identification card to form said protected printed identification card.

20. A printed identification card, comprising:

a top layer fabricated from a laminate liner, said top layer having a bottom surface, and said bottom surface of said top layer having a pressure sensitive adhesive;

a middle layer fabricated from paper stock, said middle layer having a top and a bottom surface, and said top surface being adhered to said bottom surface of said top layer by said pressure sensitive adhesive; and a bottom layer fabricated from a laminate liner, said bottom layer having a top surface, said top surface of said bottom layer having a pressure sensitive adhesive, and said top surface of said bottom layer being adhered to said bottom surface of said middle layer by said pressure sensitive adhesive.

21. The printed identification card in accordance with claim 20, wherein said at least one of said top surface and said bottom surface of said middle layer includes printed information thereon.

22. The printed identification card in accordance with claim 20, wherein said top surface of said middle layer includes printed information thereon.

23. The printed identification card in accordance with claim 22, wherein said printed information on said top surface of said middle layer is printed using non-impact printing equipment.

24. The printed identification card in accordance with claim 22, wherein said printed information on said top surface of said middle layer is printed using hot fusion laser printing equipment.

25. The printed identification card in accordance with claim 22, wherein said paper stock is 20 to 24 pound bond and said laminate liner is a 2 polyester film.

* * * * *